US011161142B2

(12) United States Patent
Evans

(10) Patent No.: US 11,161,142 B2
(45) **Date of Patent: *Nov. 2, 2021**

(54) SYSTEM AND METHOD FOR APPLICATION OF A SURFACE COMPOUND

(71) Applicant: Lisa Marie Evans, Scottsdale, AZ (US)

(72) Inventor: Lisa Marie Evans, Scottsdale, AZ (US)

( * ) Notice: Subject to any disclaimer, the term of this patent is extended or adjusted under 35 U.S.C. 154(b) by 153 days.

This patent is subject to a terminal disclaimer.

(21) Appl. No.: 16/545,435

(22) Filed: Aug. 20, 2019

(65) Prior Publication Data

US 2019/0374973 A1 Dec. 12, 2019

Related U.S. Application Data

(63) Continuation of application No. 15/281,975, filed on Sep. 30, 2016, now Pat. No. 10,413,930, which is a (Continued)

(51) Int. Cl.
*B05C 17/10* (2006.01)
*B05D 1/26* (2006.01)
(Continued)

(52) U.S. Cl.
CPC .. *B05C 17/00516* (2013.01); *B05C 17/00583* (2013.01); *B05C 17/00593* (2013.01);
(Continued)

(58) Field of Classification Search
CPC ..... B05C 17/10; B05C 17/00516; B05C 17/00583; B05C 17/00593; B05C 1/26;
(Continued)

(56) References Cited

U.S. PATENT DOCUMENTS 2,882,542 A 4/1959 Martin
3,036,327 A 5/1962 Crawford
(Continued)

FOREIGN PATENT DOCUMENTS

WO 201116437 9/2011

OTHER PUBLICATIONS

Amazon Home Improvements, CRL Reusable Caulk Tips & Cap by CR Laurence, http://www.amazon.com/Reusable-Caulk-Tips-CR-Laurence/dp/B000KZYLKA.
(Continued)

*Primary Examiner* — David J Walczak
(74) *Attorney, Agent, or Firm* — Michelle L. Gross, P.C.

(57) ABSTRACT

A compound delivery applicator comprising a substantially conical portion comprising a first end configured to couple to a compound receptacle and an applicator blade coupled to the substantially conical portion. The applicator blade comprises a first portion extending outwardly along a longitudinal axis of and from a second end of the substantially conical portion, the first portion comprising a first side edge and a second side edge each forming an acute angle relative to the longitudinal axis of the substantially conical portion and a scraper coupled to the first portion distal the substantially conical portion. The compound delivery applicator further comprises a compound delivery channel extending internally through at least a portion of the substantially conical portion, the compound delivery channel further extending through the scraper of the applicator blade and configured to pass a compound therethrough.

20 Claims, 13 Drawing Sheets

Related U.S. Application Data continuation-in-part of application No. 15/054,825, filed on Feb. 26, 2016, now Pat. No. 9,481,009, which is a continuation of application No. 14/334,607, filed on Jul. 17, 2014, now Pat. No. 9,272,305.

(60) Provisional application No. 61/847,943, filed on Jul. 18, 2013.

(51) Int. Cl.
*B05D 1/40* (2006.01)
*B05D 5/00* (2006.01)
*B05C 17/005* (2006.01)

(52) U.S. Cl.
CPC ..... *B05C 17/10* (2013.01); *B05D 1/26* (2013.01); *B05D 1/40* (2013.01); *B05D 5/005* (2013.01)

(58) Field of Classification Search
CPC .. B05C 1/40; B05C 5/005; B05D 1/26; B05D 1/40; B05D 5/005; A47L 13/08; B65D 47/44; E04F 21/02; E04F 21/026; E04F 21/06; E04F 21/08; E04F 21/16; E04F 21/165; E04F 21/1652; E04F 21/1655
USPC ..... 401/261, 266, 267
See application file for complete search history.

(56) References Cited

U.S. PATENT DOCUMENTS

| | | | | |
|---|---|---|---|---|
| 3,076,995 | A | 2/1963 | Rabelow | |
| 3,776,645 | A | 12/1973 | Hus | |
| 4,167,349 | A | 9/1979 | Dominick | |
| 4,222,678 | A | 9/1980 | Miller | |
| 4,552,477 | A | 11/1985 | Braithwaite et al. | |
| 5,496,123 | A | 3/1996 | Gaither | |
| 5,588,560 | A | 12/1996 | Benedict et al. | |
| 5,661,211 | A | 8/1997 | Todd | |
| 5,695,788 | A * | 12/1997 | Woods | B05C 17/00516 15/235.7 |
| 5,788,123 | A | 8/1998 | Hackmann et al. | |
| 5,882,133 | A * | 3/1999 | Chao | B05C 17/00516 401/266 |
| 5,882,691 | A | 3/1999 | Conboy | |
| 6,450,723 | B1 * | 9/2002 | Lithgow | B05C 17/00516 222/566 |
| 6,652,175 | B2 | 11/2003 | Yin-Kuang | |
| 6,739,482 | B2 | 5/2004 | Jaekel | |
| 7,182,538 | B2 | 2/2007 | Grosso et al. | |
| 7,325,995 | B2 | 2/2008 | Keller | |
| 7,338,227 | B2 | 3/2008 | Bullivant | |
| 7,674,059 | B2 | 3/2010 | Daigle | |
| 7,748,921 | B2 | 7/2010 | Puczkowski | |
| 7,841,796 | B2 | 11/2010 | Bruggeman et al. | |
| 7,854,562 | B2 | 12/2010 | Peterson et al. | |
| 8,146,604 | B2 | 4/2012 | Wright et al. | |
| 8,424,483 | B2 | 4/2013 | Ling et al. | |
| 2008/0145138 | A1 | 6/2008 | Bencsics et al. | |
| 2010/0239356 | A1 | 9/2010 | Caulier | |
| 2011/0027753 | A1 | 2/2011 | Maruat | |
| 2012/0121315 | A1 | 5/2012 | Haack | |
| 2013/0193168 | A1 | 8/2013 | Ginter | |

OTHER PUBLICATIONS

Amazon, Wood River Glue Bottle Applicator Set, http://www.amazon.com/WoodRiver-Glue-Bottle-Applicator-Set/dp/B0039ZB6ZG.

Rangate.com, Pizzi Roller spatula, http://rangate.com/specialtyproducts/pizzi_accessories.php.

The Woodworker's News and Reviews, New Glue Applicator Kit Is All-in-one Solution, http://thewoodworkersnews.com/2013/07/new-glue-applicator-kit-is-all-in-one-solution/.

True Wave, Wagner spray tech trim-it all-in-one trim tool & paint applicator, http://www.truevalue.com/product/Trim-It-All-/In-One-Trim-Tool-Paint-Applicator/14694.uts.

* cited by examiner

SYSTEM AND METHOD FOR APPLICATION OF A SURFACE COMPOUND

CROSS REFERENCE TO RELATED APPLICATIONS

This document is a continuation of U.S. Pat. No. 10,413,930 entitled "System and Method for Application of a Surface Compound" to Lisa Marie Evans, which was filed on Sep. 30, 2016 which is a continuation in part of U.S. Pat. No. 9,481,009 entitled "System and Method of Application of a Surface Compound" to Lisa Marie Evans, which was filed on Feb. 26, 2016 which is a continuation of U.S. Pat. No. 9,272,305 entitled "System and Method of Application of a Surface Compound" to Lisa Marie Evans, filed on Jul. 17, 2014 which claims the benefit of the filing date of U.S. Provisional Patent Application No. 61/847,943, entitled "Patch Delivery Systems" to Lisa Marie Evans, which was filed on Jul. 18, 2013, the disclosures of which is hereby incorporated entirely by reference herein.

BACKGROUND

1. Technical Field

Aspects of this document relate generally to systems and methods for applying viscous materials to a surface.

2. Background Art

Holes and other imperfections in walls, ceilings, floors, and other surfaces are often repaired using a compound such as a wall-patch material that is customarily applied using a semi-flexible knife and is sourced from a single-batch container that typically contains far more compound than will be used in a single application. This process typically introduces problems such as wasted compound, source contamination, and messy application thereby resulting in the user discarding unused and contaminated compound which increases the cost of such repairs due to this wasted and discarded product. The tools involved may also be unwieldy and require additional time and cost in cleaning and storing such tools for future use.

SUMMARY

Implementations of a compound delivery applicator may comprise a substantially conical portion comprising a first end configured to couple to a compound receptacle and an applicator blade coupled to the substantially conical portion. The applicator blade may comprise a first portion extending outwardly along a longitudinal axis of and from a second end of the substantially conical portion, the first portion comprising a first side edge and a second side edge each forming an acute angle relative to the longitudinal axis of the substantially conical portion and a scraper coupled to the first portion distal the substantially conical portion, the scraper comprising a recessed channel along at least a portion of an edge of the scraper distal from the first portion of the applicator blade. The compound delivery applicator may further comprise a compound delivery channel proximate at least one of the first and second side edges of the first portion of the applicator blade and extending internally through at least a portion of the substantially conical portion, the compound delivery channel further extending through the scraper of the applicator blade and configured to pass a compound therethrough and a flow control button located within the recessed channel of the scraper.

Particular aspects may comprise one or more of the following features. The scraper may further comprise a distribution surface comprising an opening configured to pass compound from the compound delivery channel therethrough. The distribution surface may form an acute angle relative to the longitudinal axis of the substantially conical portion. The recessed channel may be located on a surface of the scraper other than the distribution surface. The compound delivery applicator may further comprise a pen body configured to house a compound receptacle therein, a plunger, and a spring surrounding at least a portion of the compound delivery channel, wherein the spring and plunger are configured to dispense a compound within the compound receptacle when the plunger is depressed. The compound delivery applicator may further comprise a tab located proximal the substantially conical portion. The compound delivery applicator may be configured to pivot laterally about the longitudinal axis. The compound delivery applicator may be configured to pivot vertically about the longitudinal axis. The compound delivery applicator may further comprise a sanding surface located on an exterior surface of at least one of the substantially conical portion and the applicator blade.

Implementations of a compound delivery applicator may comprise a substantially conical portion comprising a first end configured to couple to a compound receptacle and an applicator blade coupled to the substantially conical portion. The applicator blade may comprise a first portion extending outwardly along a longitudinal axis of and from a second end of the substantially conical portion, the first portion comprising a first side edge and a second side edge each forming an acute angle relative to the longitudinal axis of the substantially conical portion and a scraper coupled to the first portion distal the substantially conical portion. The compound delivery applicator may further comprise a compound delivery channel extending internally through at least a portion of the substantially conical portion, the compound delivery channel further extending through the scraper of the applicator blade and configured to pass a compound therethrough.

Particular aspects may comprise one or more of the following features. An edge of the scraper may comprise a first edge portion and a second edge portion forming an angle with each other within a range of 90 to 120 degrees. The edge of the scraper may further comprise a third edge portion and a fourth edge portion that are substantially parallel to one another. The compound delivery applicator may further comprise a sanding surface located on an exterior surface of at least one of the substantially conical portion and the applicator blade. The compound delivery applicator may further comprise a cap configured to fit over the compound delivery applicator and secure to a compound receptacle. The cap may further comprise a sanding surface on an end of the cap distal from an open end of the cap. A first end of the substantially conical portion may be threaded such that it is configured to threadably couple to the compound receptacle. The compound delivery applicator may be configured to pivot laterally about the longitudinal axis. The compound delivery applicator may be configured to pivot vertically about the longitudinal axis. The compound delivery applicator may further comprise a pen body configured to house a compound receptacle therein, a plunger, and a spring surrounding at least a portion of the compound delivery channel, wherein the spring and plunger are configured to dispense a compound within the compound receptacle when the plunger is depressed. The compound delivery applicator may further comprise a tab located proximal the substantially conical portion.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventor is fully aware that she can be her own lexicographer if desired. The inventor expressly elects, as her own lexicographer, to use only the plain and ordinary meaning of terms in the specification and claims unless she clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of post-AIA 35 U.S.C. § 112(f). Thus, the use of the words "function," "means" or "step" in the Description, Drawings, or Claims is not intended to somehow indicate a desire to invoke the special provisions of post-AIA 35 U.S.C. § 112(f), to define the invention. To the contrary, if the provisions of post-AIA 35 U.S.C. § 112(f) are sought to be invoked to define the claimed disclosure, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of post-AIA 35 U.S.C. § 112(f). Moreover, even if the provisions of post-AIA 35 U.S.C. § 112(f) are invoked to define the claimed disclosure, it is intended that the disclosure not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or methods disclosed herein. Many additional components and assembly procedures known in the art consistent with the intended compound delivery apparatus and related methods will become apparent for use with particular implementations from this disclosure. Accordingly, for example, although particular implementations are disclosed, such implementations and implementing components may comprise any components, models, versions, quantities, and/or the like as is known in the art for such systems and implementing components, consistent with the intended operation.

The present disclosure relates to systems and methods for applying a surface compound such as by non-limiting example, wall-patch, Spackle®, putty, adhesive, caulk, paint, stain, and other similar substances.

Figure 2:
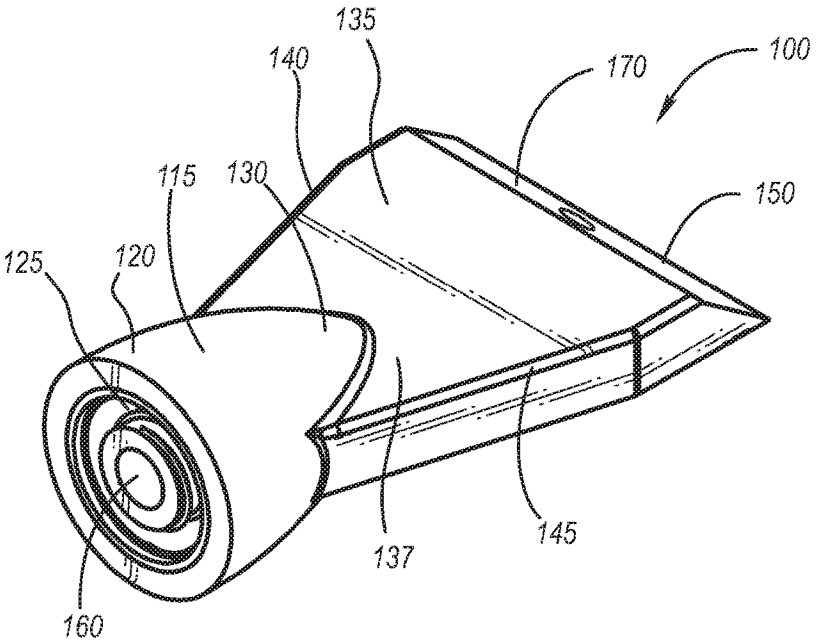
FIGS. 1-2 depict implementations of a compound delivery applicator.
Figure 4:
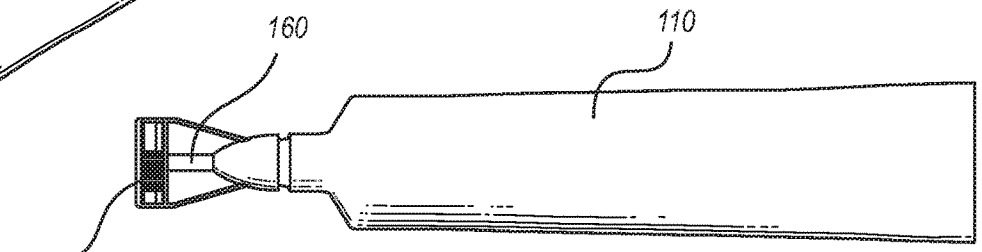
FIGS. 3-4 depict implementations of a compound delivery applicator used with a compound receptacle that comprises a tube.
Figure 1:
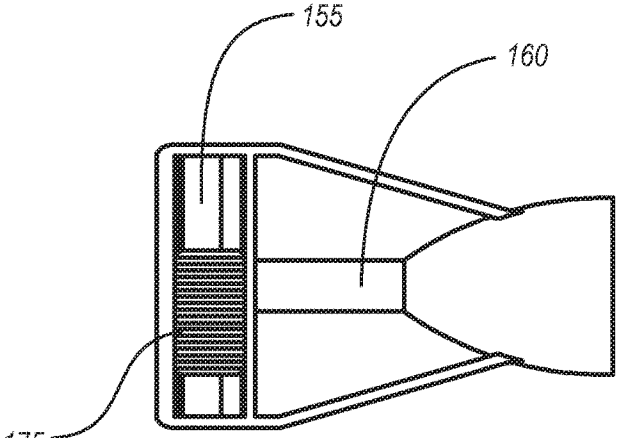
Figure 3:
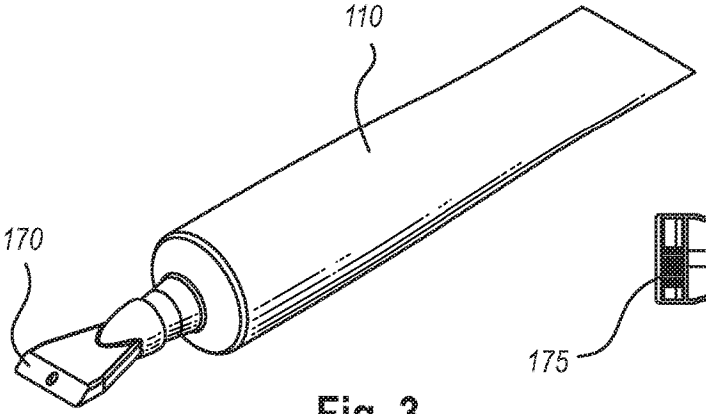
Figure 5:
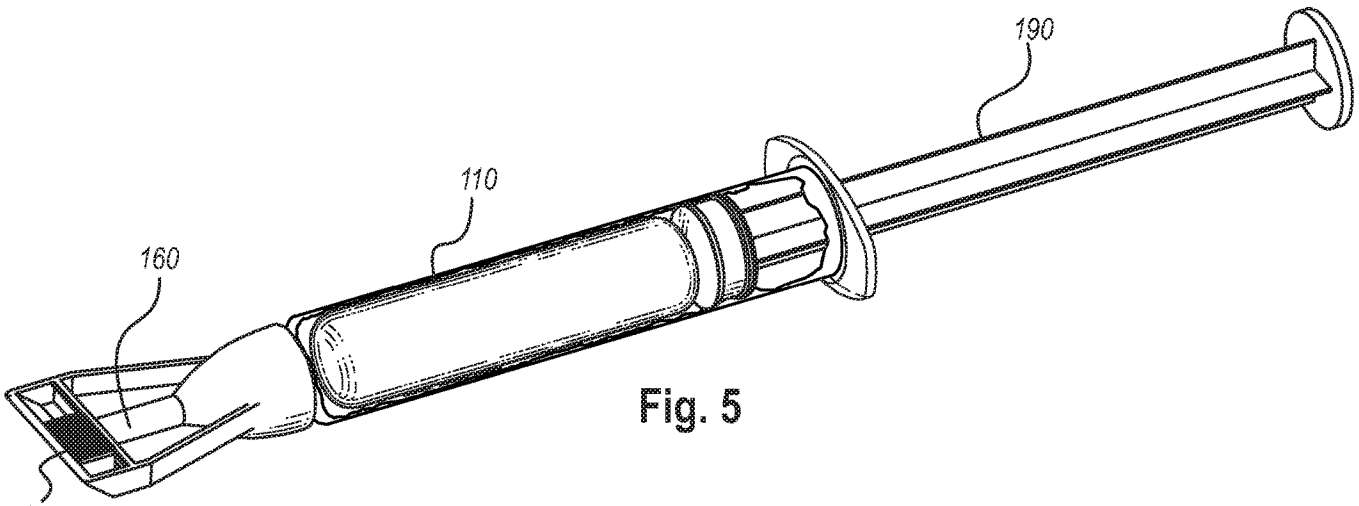
FIGS. 5-6 depict implementations of a compound delivery applicator used with a plunger-actuated compound receptacle.

FIGS. 1-2 show an implementation of a compound delivery applicator 100 for use with a tube or other compound receptacle 110, as depicted in FIGS. 3-5. Some embodiments may comprise a substantially conical portion 115 having a first end 120 configured to couple to the compound receptacle 110. While it is intended that any appropriate coupling methodology may be implemented, in some implementations, the first end 120 may comprise one or more threads 125 to threadably couple with a tube or other compound receptacle 110. In other implementations, threads may not be necessary as the applicator may slide or otherwise be non-threadably coupled to the compound receptacle.

As shown, an applicator blade 135 is coupled to a second end 130 of the substantially conical portion 115 of the compound delivery applicator 100. The applicator blade 135 comprises a first portion 137 that extends outwardly from the second end 130 of the substantially conical portion 115 and along a longitudinal axis of the substantially conical portion 115. First and second side edges 140, 145 extend outward from the second end 130 of the conical portion each forming an acute angle relative to the longitudinal axis of the substantially conical portion 115. A scraper 150 is coupled to the first portion 137 of the applicator blade 135 at a location that is distal from the substantially conical portion 115. In some implementations, the scraper 150 may comprise a recessed channel 155 located on a surface of the scraper as depicted in FIGS. 1 and 4-5 at a location that is distal from the substantially conical portion 115 and the first portion 137 of the applicator blade 135. The recessed channel 155 may run along substantially the entire scraper edge or along any portion of the scraper edge.

Figure 6:
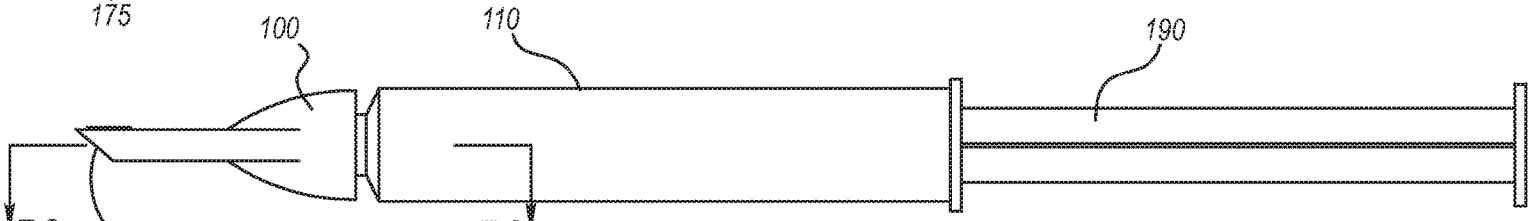
Figure 8:
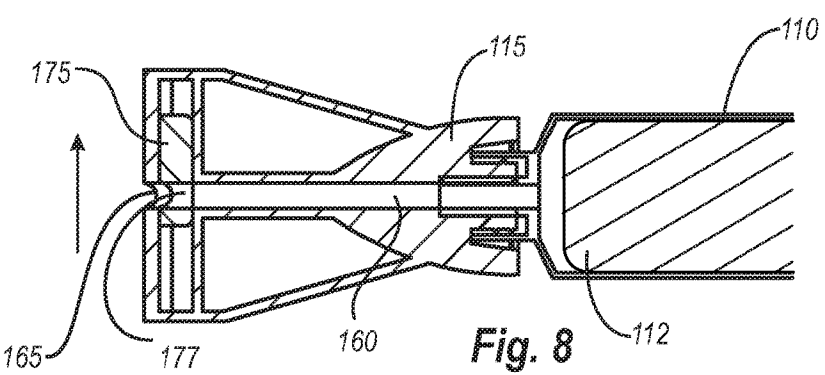
FIGS. 7-8 depict a cross-sectional view of an implementation of a compound delivery applicator comprising a slidable flow control button.
Figure 7:
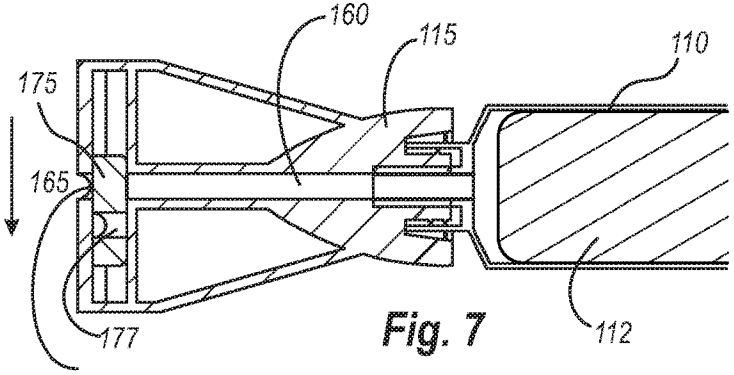

FIGS. 7 and 8 provide a cross-sectional view of an implementation of a compound delivery applicator 100 as shown in FIG. 6. A substantially cylindrical hollow compound delivery channel 160 extends longitudinally through at least a portion of the substantially conical portion 115, applicator blade 135, and/or scraper 150 such that a compound held in the compound receptacle 110 to which the applicator 100 is coupled may pass through the compound delivery channel 110 and be applied to a surface as the compound exits the opening 165 in the scraper 150.

Figure 12B:
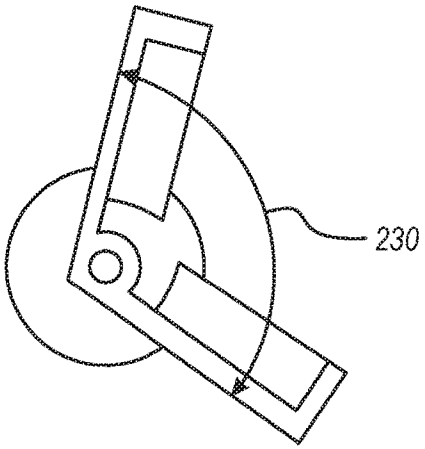
Figure 12A:
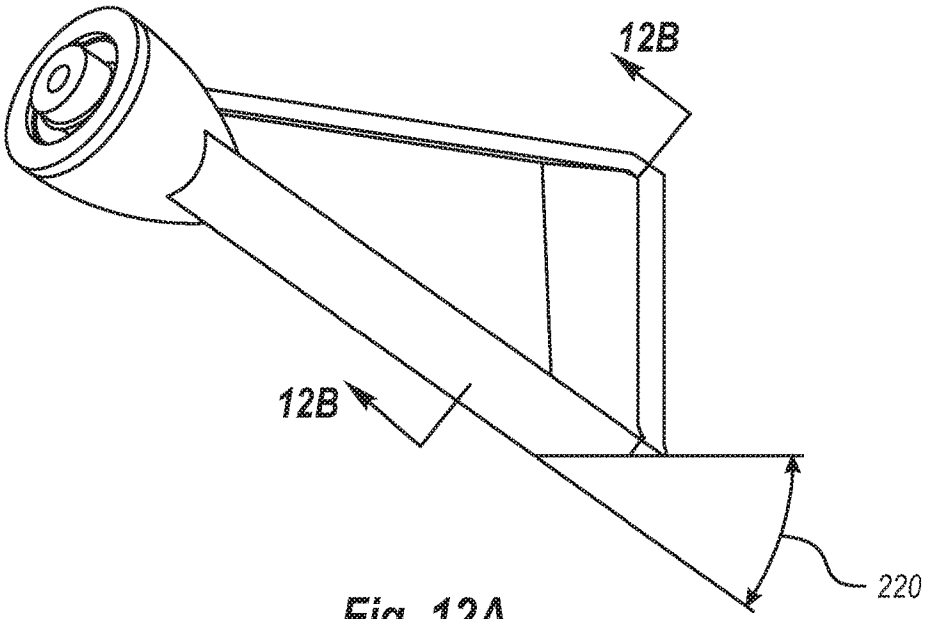

In some implementations, as shown in FIGS. 2-3 and 6, the scraper 150 further comprises a distribution surface 170 which allows compound to pass from the compound delivery channel 160 and through an opening 165 in the distribution surface 170 for application to a wall, floor, or other appropriate surface to which application of the compound is desired. In some embodiments, the recessed channel 155 is located on a surface of the scraper 150 other than the distribution surface 170. While it is contemplated that the distribution surface 170 may be configured to have any angle that is desirable for easing of use in applying the compound, in some embodiments, it may be preferable to orient the distribution surface 170 such that it forms an acute angle 220 relative to the longitudinal axis of the substantially conical portion 115 of the applicator as shown in FIG. 12A. It should be noted that terms such as underside, top, underneath, etc. are used for descriptive purposes with reference to the orientation and views depicted in the figures and are not intended to limit the orientation of the applicator when in use. One of ordinary skill in the art would recognize that the applicator may be more easily and effectively used in different orientations relative to the surface to which the compound is being applied depending on the angular orientation of and the type of surface (e.g. vertical wall, horizontal ceiling, etc.).

Figure 9:
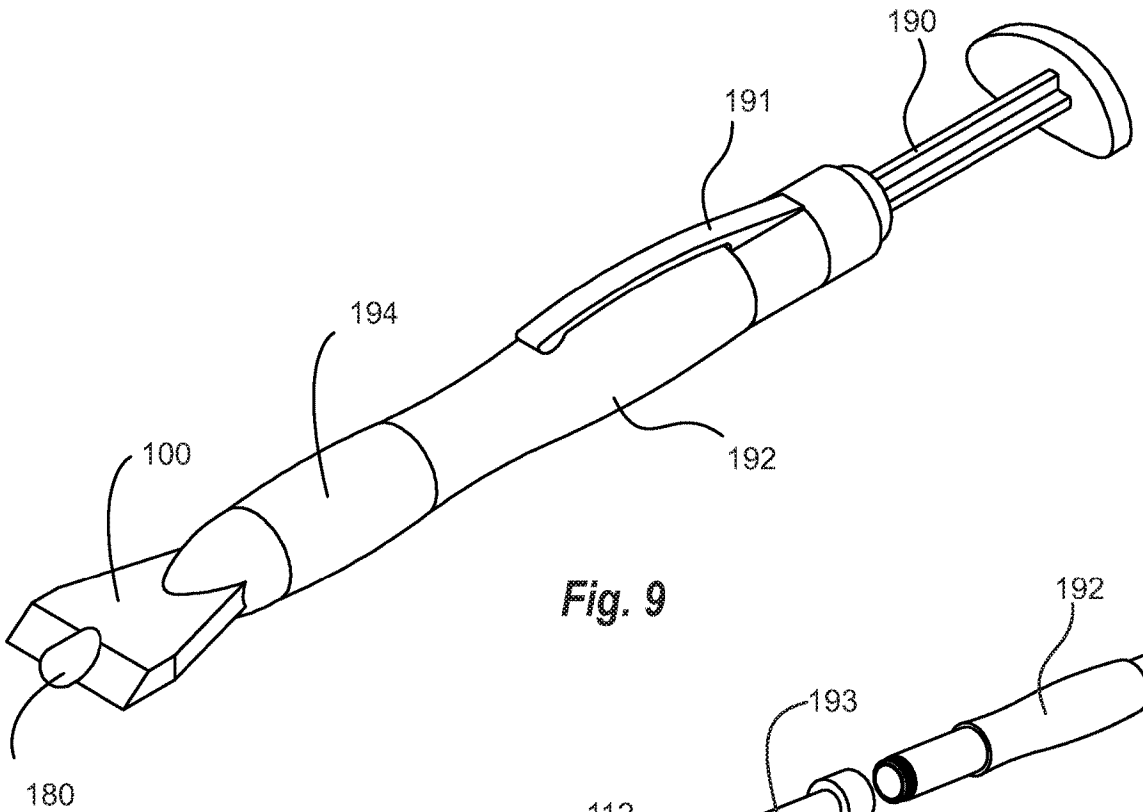
FIGS. 9-10 and 32-33 depict implementations of a compound delivery applicator used with a spring-actuated plunger.
Figure 10:
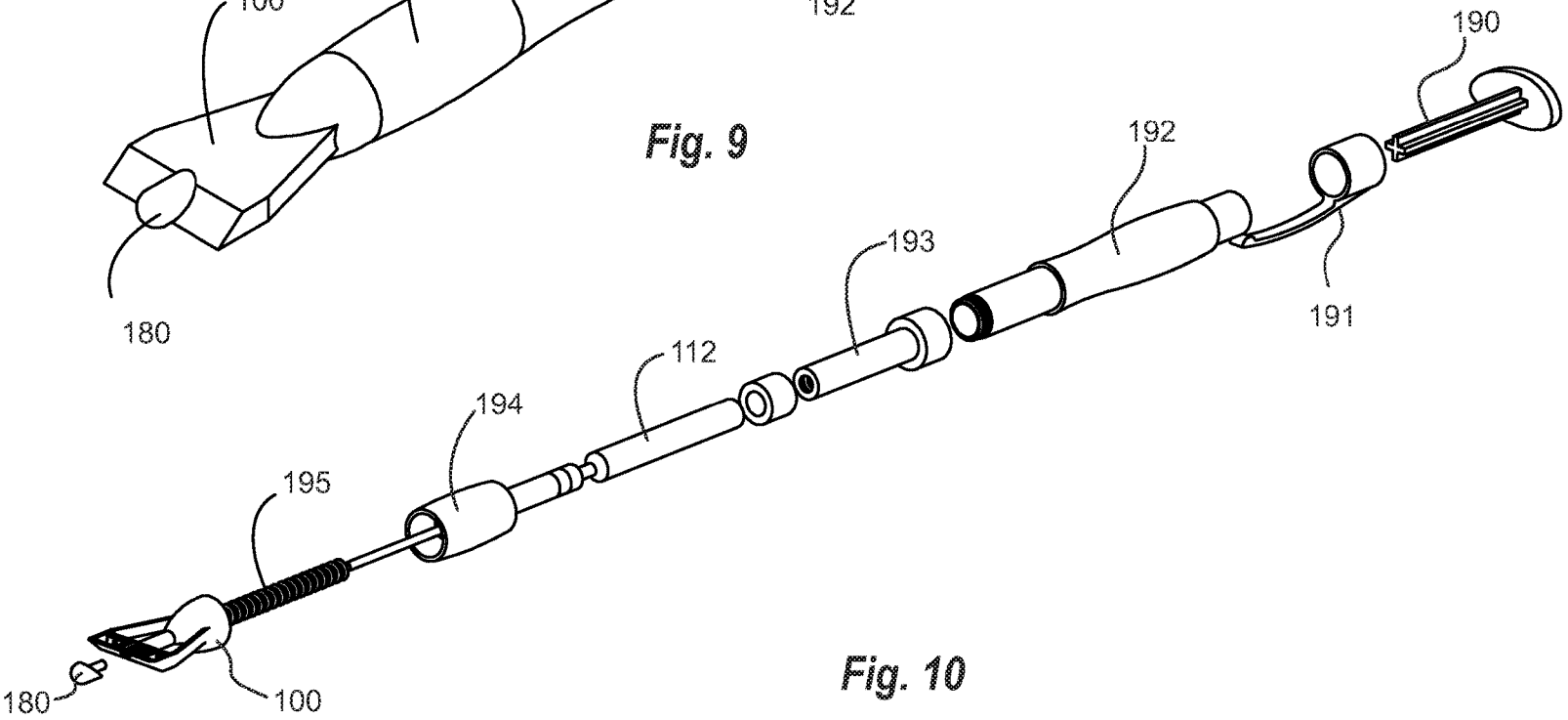
Figure 11B:
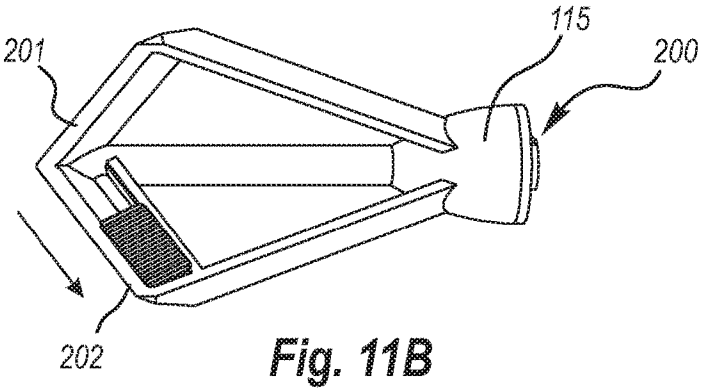
FIGS. 11A-14 depict implementations of a compound delivery applicator comprising a scraper with a plurality of edge portions for use at an abutment of two surfaces.
Figure 11A:
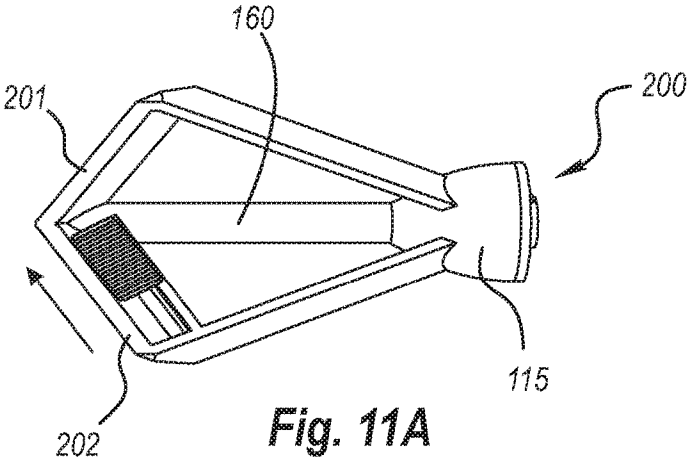

Some embodiments of the compound delivery applicator 100 may further comprise a flow control button 175 that allows a user to control flow of the compound by allowing the compound to flow freely from the opening 165 in the scraper 150 when the flow control button 175 is in an open position and prevent compound from flowing through the opening 165 when the flow control button 175 is in the closed position. The flow control button 175 may be located within the recessed channel 155 of the scraper 150 and may slide or otherwise move within the recessed channel 155 to control the flow of compound application. As shown in FIGS. 7 and 8, the flow control button 175 may comprise a channel, opening, or other hollow passageway 177 that aligns with the substantially cylindrical hollow compound delivery channel 160 and the opening 165 in the scraper 150 such that when the flow control button 175 is slid or otherwise located in an open position in the recessed channel 155 as shown in FIG. 8, the hollow passageway 177 couples with the substantially cylindrical hollow compound delivery channel 160 and the opening 165 in the scraper 150 to form a continuous pathway for the compound to flow through. The flow control button 175 may also be slid or otherwise positioned into a closed position as shown in FIG. 7 such that the hollow passageway 177 does not align with the substantially cylindrical hollow compound delivery channel 160 and opening 165 in the scraper 150 thereby obstructing the flow of the compound. Alternatively, as shown in FIGS. 9-10, flow of compound may be obstructed by inserting a plug 180 or other stopper into the opening located on the distribution surface 170 of the scraper 150. To increase the ease with which a user may slide or otherwise move the flow control button 175, a texture such as ridges, bumps, depressions, or any other suitable texture or pattern may be present on the outward-facing surface of the flow control button 175.

While some implementations of the compound delivery applicator may comprise a scraper 150 having a single edge portion that is flat and uniform for use in applying compound to a flat surface such as depicted in FIGS. 1-8, for some applications, such as applying compound to a corner or other abutment of two surfaces, it may be preferable that applicator 200 has a scraper 150 that comprises a plurality of edge portions to aid the user in smoothly applying the compound. For example, as shown in FIGS. 11A-18, the scraper may comprise a first edge portion 201 and a second edge portion 202 that meet a juncture to form an edge that is more suitable for applying compound to a corner. While the first and second edge portions may be configured to form any suitable angle, it may be preferable that the first and second edge portions form an angle 230 that is within a range of 90 to 120 degrees relative to each other for use in corners or other application in which two flat surfaces meet at a right angle. In some embodiments, as shown in FIG. 12B, an angle 230 of approximately 111 degrees may be preferable; however this angle may differ as needed depending on the various dimensions and angles of other portions of the applicator and/or applicator blade.

Figure 14:
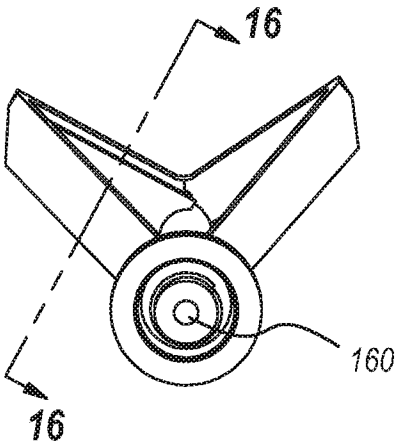
Figure 13:
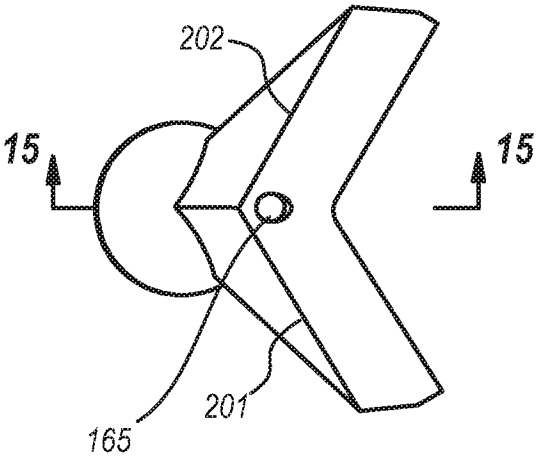
Figure 31:
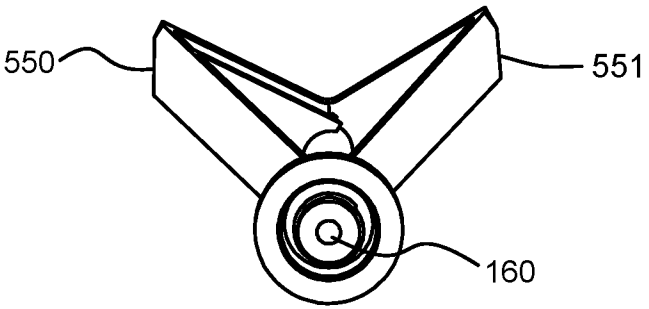
FIGS. 30-31 depict implementation of a compound delivery applicator comprising an angled scraper blade for use in wall corners.
Figure 30:
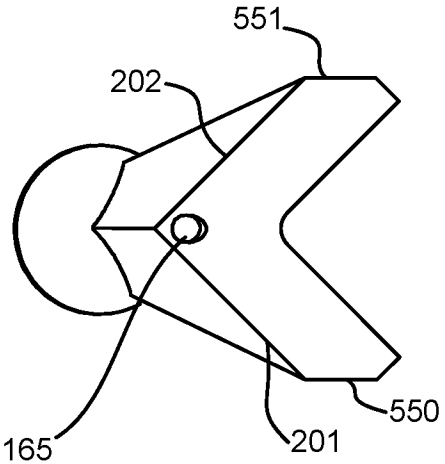
Figure 32:
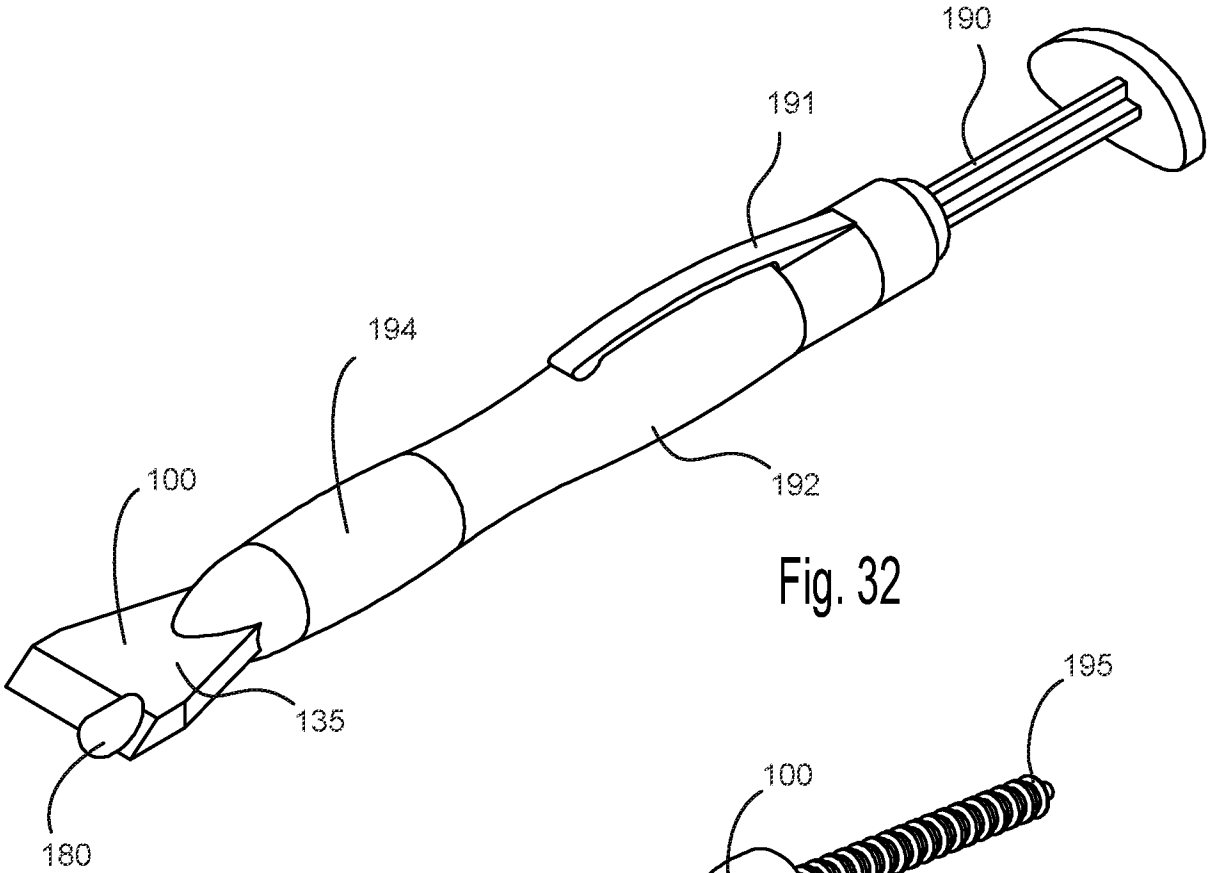
Figure 33:
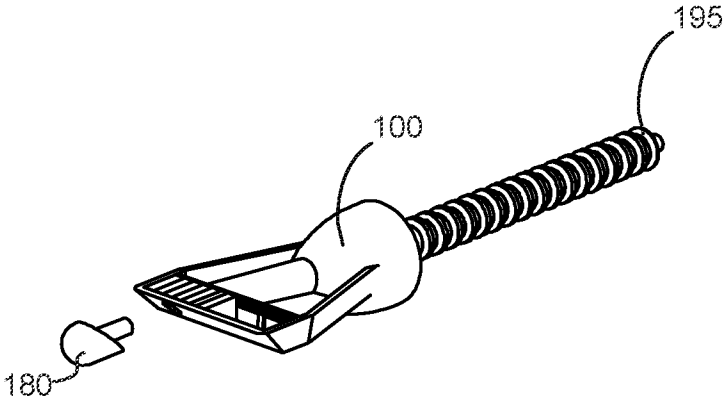

FIGS. 13-14 provide end views of the compound delivery applicator 200 having first and second scraper edge portions 201, 202 that meet at approximately an angle within a range of 90 to 120 degrees relative to each other. For embodiments comprising a distribution surface 170, while any appropriate angle may be used, it may be preferable to enhance ease of scraping and leveling the compound being applied to orient one or more distribution surfaces corresponding to the first and/or second scraper edge portions at an angle that is acute relative to the longitudinal axis of the substantially conical portion. In some embodiments, it may be advantageous to locate the substantially cylindrical hollow compound delivery channel 160 such that it substantially bisects the angle formed by the first and second scraper edge portions as can be seen in FIGS. 11A-12B. As shown in FIG. 13, in some implementations, the opening 165 in the distribution surface 170 that is coupled to the substantially cylindrical hollow compound delivery channel 160 may be located proximal to an edge of the distribution surface, however, it is intended that this opening 165 be located anywhere along the distribution surface 170 that is appropriate for ease of use in applying compound using the applicator. FIGS. 30-31 further depict an implementation in which the compound delivery applicator 200 further comprises third and fourth scraper edge portions 550, 551 that are substantially parallel to each other which may be advantageous when the first and second scraper edge 201, 202 portions meet at an angle that is about 90 degrees relative to each other for applying a compound at a corner where two wall or floor surfaces meet.

Figure 16:
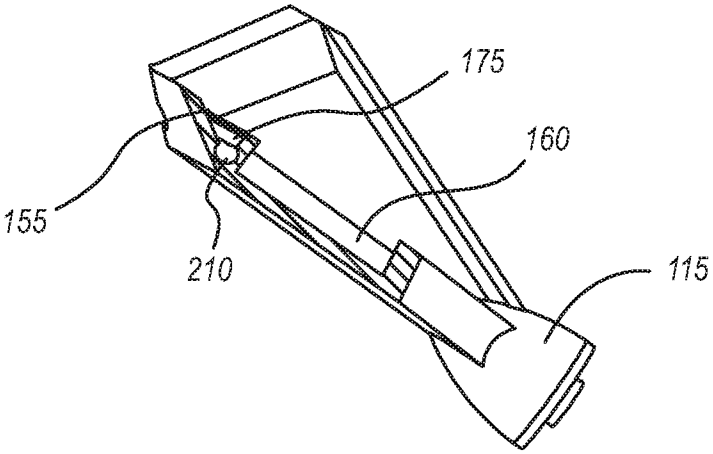
FIGS. 15-16 depict a cross-sectional view of implementations of a compound delivery applicator comprising a plurality of scraper edge portions.
Figure 15:
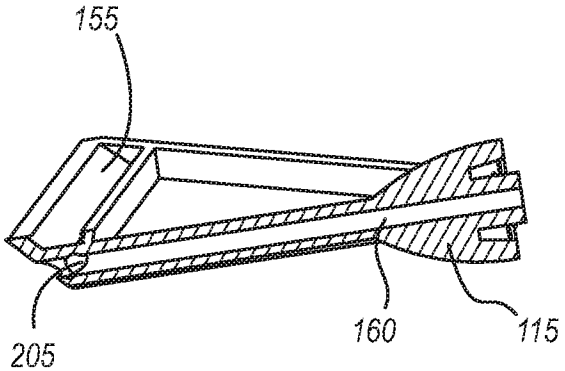
Figure 17:
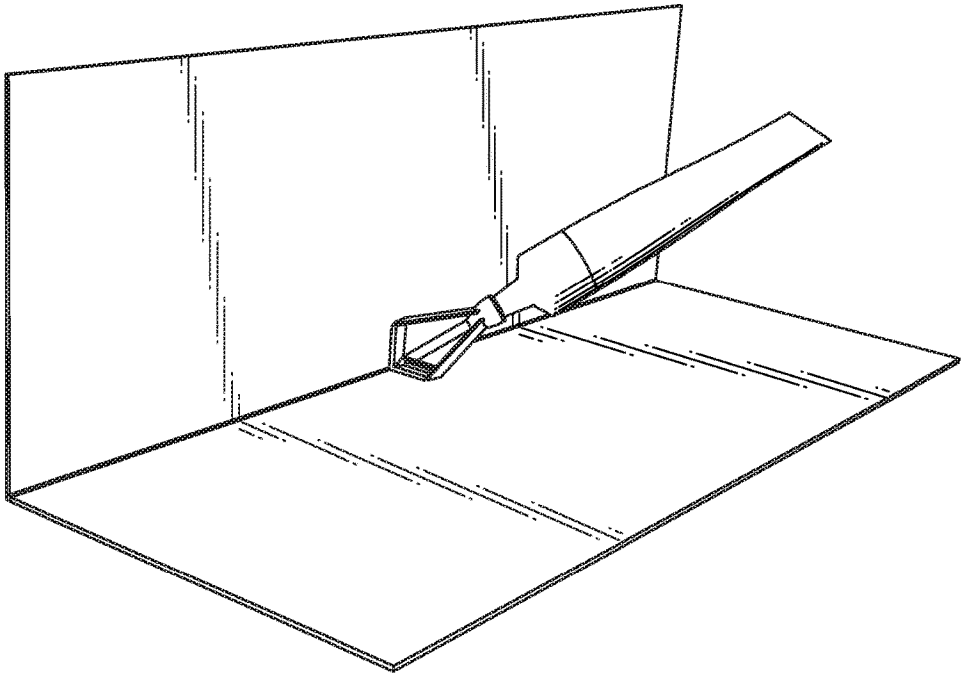
FIGS. 17-19 depict implementations of a compound delivery applicator in use at an abutment of two surfaces and in conjunction with a compound receptacle.
Figure 19:
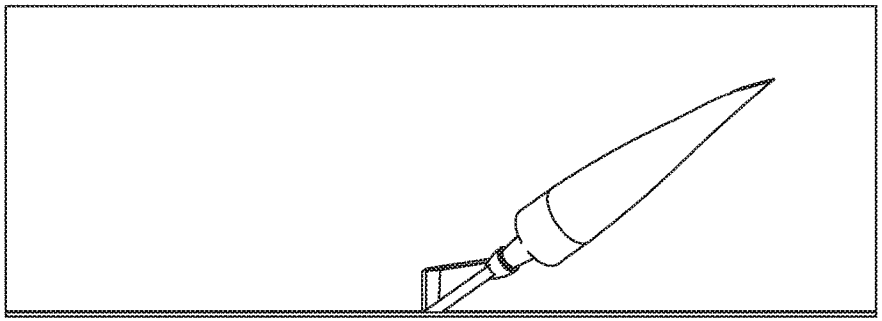
Figure 18:
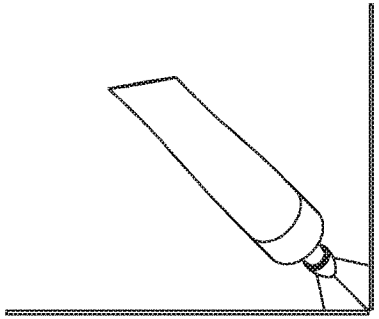
Figure 20:
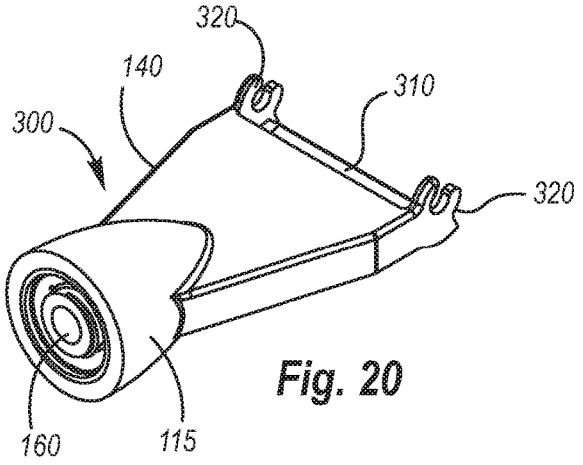
FIGS. 20-24 depict implementations of a compound delivery applicator comprising a roller.

Additionally as shown, the applicator 200 may further comprise a recessed channel 155 running along at least a portion of one or more scraper edge portions 201, 202 distal from the substantially conical portion 115. While it is contemplated that the recessed channel 155 may be located on either surface of the scraper 150, in some implementations, it may be preferable to locate the channel 155 on an opposite surface from that on which the opening 165 in the distribution surface 170 is located for ease of operation of a flow control button 175 that may be located in the recessed channel 155. The flow control button 175 may be slidably operated by moving the flow control button 175 within the recessed channel 155 between and open and closed position to control the flow of the compound being applied. Some embodiments may utilize a similar flow control button structure as the single edge-portion embodiment of the applicator in which the flow control button 175 comprises a hollow portion 177 configured to align with the substantially cylindrical hollow compound delivery channel 160 and the opening 165 in the distribution surface 170. Due to the angled design of the scraper edge portions in this embodiment, however, in some implementations, it may be preferable to utilize a flow control button 175 that is structured such that at least a portion of the flow control button obstructs the substantially cylindrical hollow compound delivery channel when it is placed in a closed position that is aligned with the substantially cylindrical hollow compound delivery channel 160. Alternatively, when the flow control button is slid or otherwise located within the recessed channel 155 in an open position, the flow control button 175 does not obstruct the flow of compound through the substantially cylindrical hollow compound delivery channel 160. To accomplish this, the flow control button 175 may comprise a protrusion 210 extending outward from the flow control button such that the protrusion 210 at least partially obstructs the substantially cylindrical hollow compound delivery channel when in the closed position. As depicted in FIGS. 15-16, the substantially cylindrical hollow compound delivery channel may comprise one or more openings 205 within the recessed channel to accommodate such a protrusion 210 or other portion of the flow control button 175 that is used to impede compound flow.

FIGS. 20-24 depict implementations of a compound delivery applicator 300 designed for use with compounds such as for example, paint, stain, or adhesive, that may be easily distributed and applied using a roller. As shown, the substantially cylindrical hollow compound delivery channel 160 may open into a roller channel 310 that is configured to allow the accumulated compound to contact a surface of a roller 330 when the roller is coupled via one or more roller brackets 320 which may be located on either end of the roller channel 310. Similar to other embodiments of a compound delivery applicator described herein, the applicator blade 135 may comprise a first portion comprising first and second side edges 140, 145 each forming an acute angle relative to the substantially conical portion 115 through which the substantially cylindrical hollow compound delivery channel 160 passes.

Figure 21:
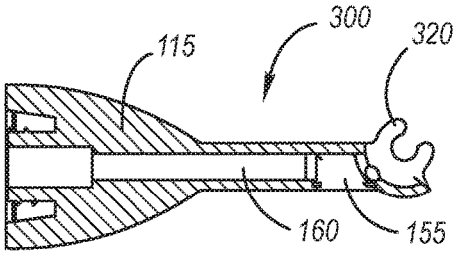
Figure 22:
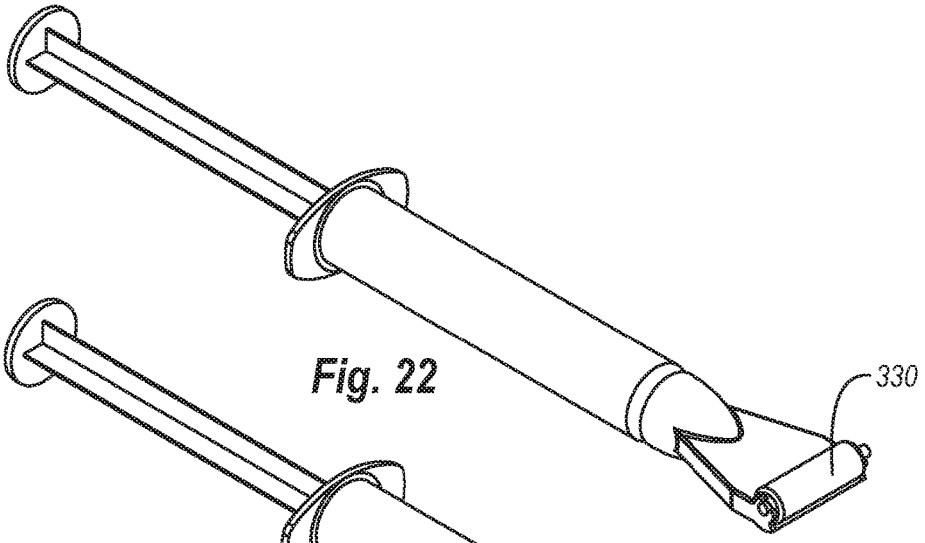
Figure 23:
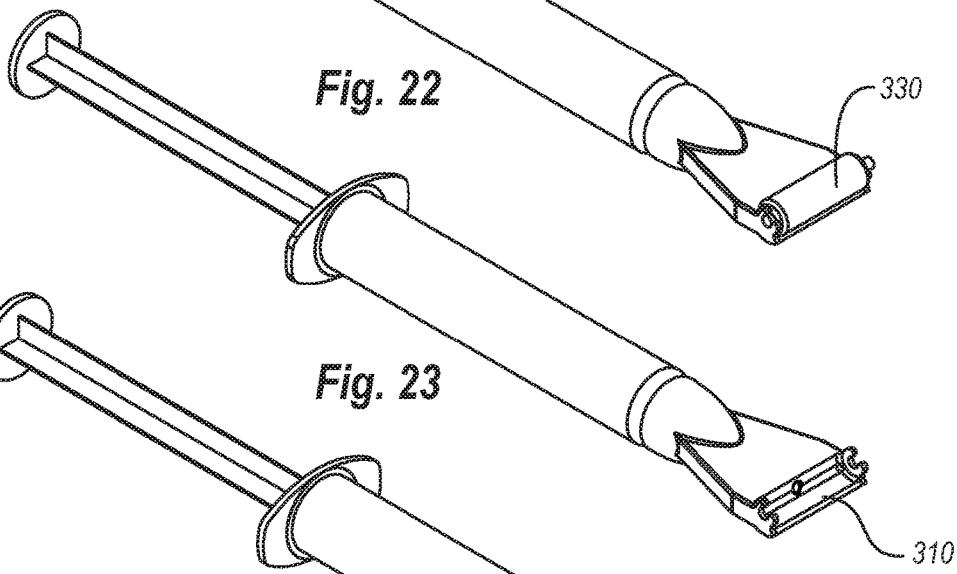
Figure 24:
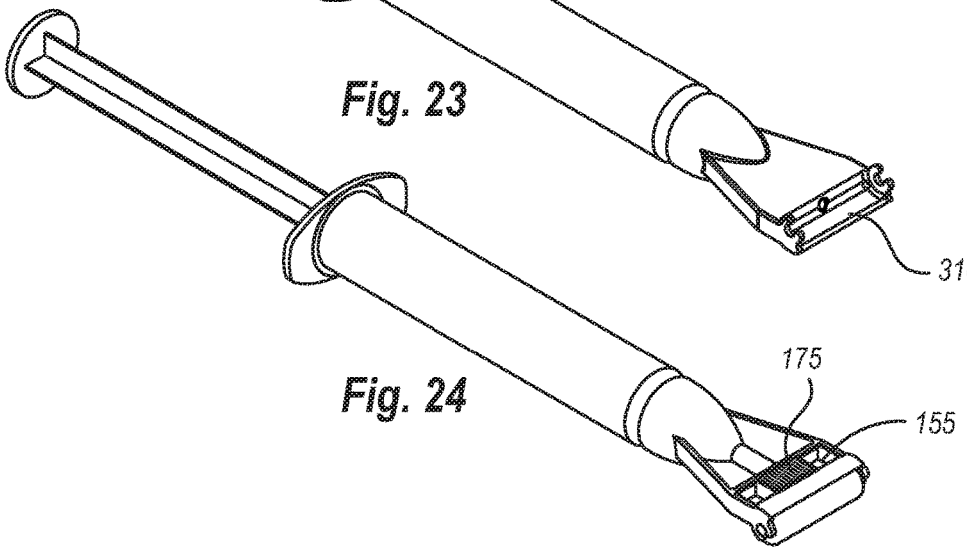

In some implementations as shown in FIGS. 21 and 24, the compound delivery applicator 300 may further comprise a recessed channel 155 located substantially adjacent to the roller channel 310. The recessed channel 155 may be configured to house a flow control button 175 therein, which may slidably move along the recessed channel 155 to obstruct or allow flow of the compound as desired by the user. It is contemplated that the flow control button 175 may have any such characteristics or features as described above and related to the other embodiments of a compound delivery applicator described herein.

Any of the embodiments of a compound delivery applicator contemplated by this disclosure may comprise one or more threads 125 to threadably couple to a compound receptacle 110. Alternatively, some embodiments may slide onto or slidably mate with a compound receptacle 110 such as an existing tube of compound such as caulk or wall-patch. In some embodiments, the compound receptacle 110 may comprise a disposable or refillable cartridge 112, as shown in FIGS. 7-8 which may be housed inside the compound receptacle 110 and may be replaced or refilled after use.

It is intended that the compound be dispensed by applying a pressure to the compound inside the compound receptacle 110 which may be accomplished by a user squeezing a compound receptacle 110 that is comprised of a flexible material, such as for example, a tube. Alternatively a plunger 190 may be used in conjunction with a spring 195 or other pressurizing device to apply a pressure to the compound within the compound receptacle 110 and/or cartridge 112. Such a plunger 190 may also be used in a syringe-like configuration to draw viscous compound into the compound receptacle 110. In some embodiments, the compound delivery applicator may be coupled to a pen-like or syringe-like body as shown in FIGS. 9-10 and 32-33 which may comprise any appropriate configuration of components such as a plunger 190, a piston advance body 193, an advancing piston or spring 195, a cartridge 112, a clip 191, a body 192, and a grip portion 194.

Figure 27:
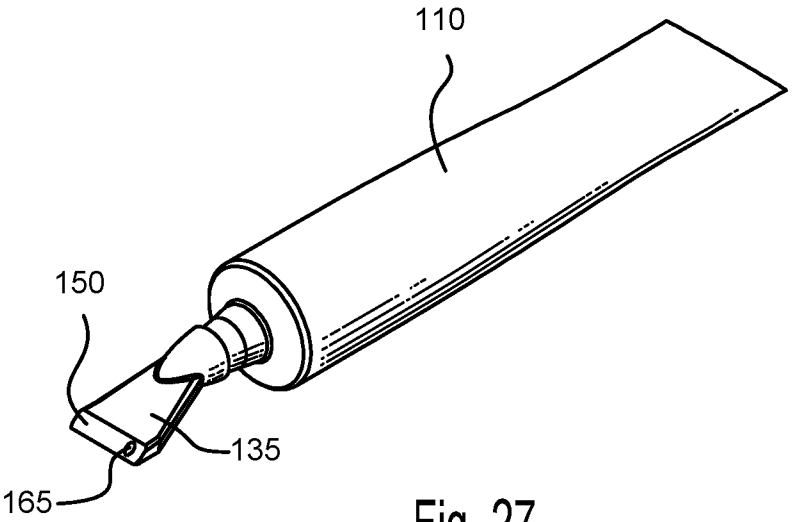
FIGS. 26-27 depict implementations of a compound delivery applicator comprising a compound delivery channel proximate a side edge of the applicator blade.
Figure 26:
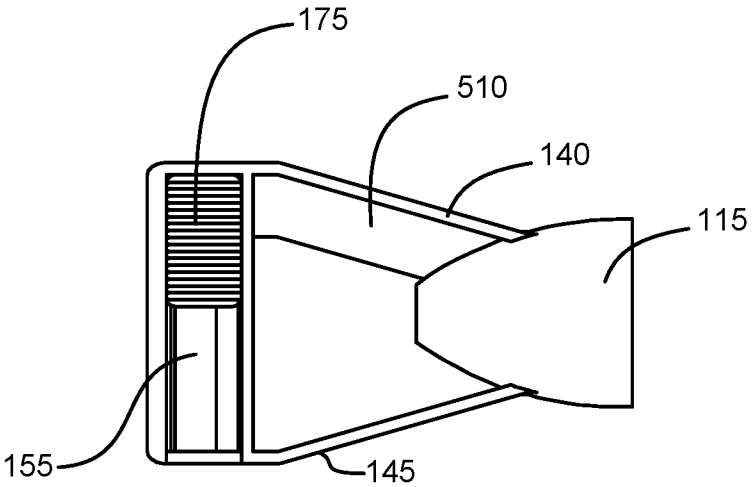

As shown in FIGS. 26-27, some implementations of a compound delivery applicator 100 may comprise a compound delivery channel 510 located elsewhere than along the longitudinal axis of the substantially conical portion 115. For example, the compound delivery applicator may be located proximate a first 140 or second edge 145 of the applicator blade 135. Accordingly, the opening 165 in the distribution surface 170 of the scraper 150 may also be located at a location other than at the center of the scraper 150 such as for example, proximate the side of the scraper along with the distribution channel 510 runs. It is contemplated that this location of the distribution channel 510 elsewhere than along the longitudinal axis of the substantially conical portion may be applied to any of the implementations of this disclosure, including, by non-limiting example, with the compound receptacle 110 and plunger 190 implementation of FIGS. 5 and 28 as well as with the spring-actuated implementation of FIGS. 9-10 and 32-33.

Figure 28:
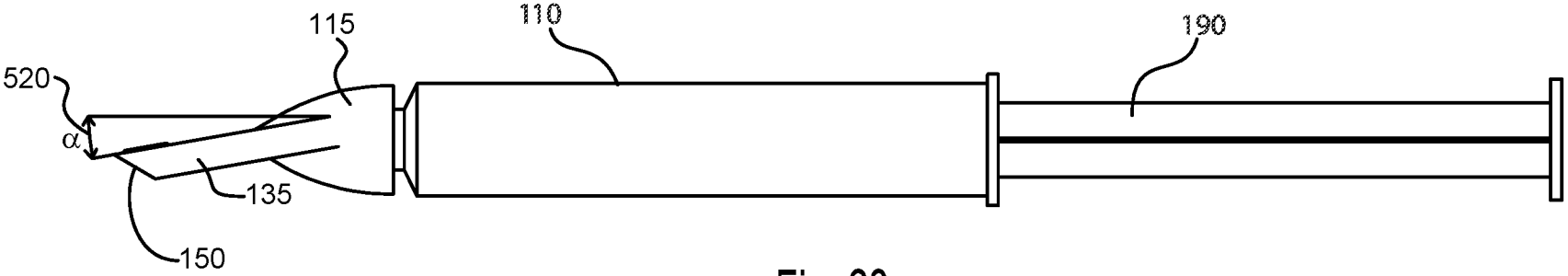
FIG. 28 depicts a range of angles of the applicator blade in accordance with implementation of a compound delivery applicator.

It is also contemplated, as shown in FIG. 28, that some implementations of a compound delivery applicator 100 may be configured such that an angle 520 between the applicator blade 135 and the horizontal plane may be different depending on the desired use and surface conditions at the location at which a compound is being applied. In some implementations, this angle 520 may be adjustable by about 45 degrees and in other implementations, a variety of compound delivery applicators 100 having differently angled applicator blades 135 may be available for interchangeable use.

Figure 29:
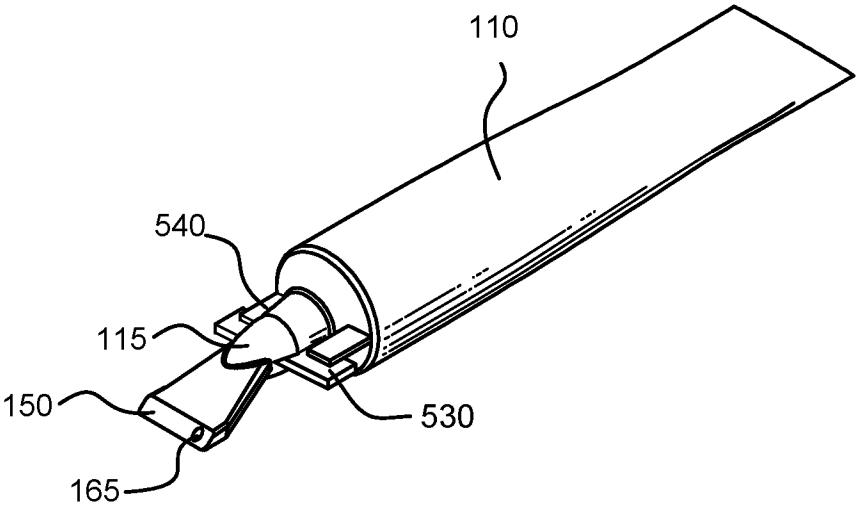
FIG. 29 depicts an implementation of a compound delivery applicator comprising one or more tabs.

Regardless of the location of the compound delivery channel 510, in some implementations, the compound delivery applicator 100 comprises one or more tabs 530 proximal the substantially conical portion 115. In some embodiments, it may be preferable to locate at least one tab 530 on either side of the substantially conical portion 115 at an orientation such that each tab 530 is substantially parallel to a surface onto which a compound is being applied as shown in FIG. 29. Thus, when a user is applying compound using the compound delivery applicator 100, the tab(s) 530 maintain the compound delivery applicator 100 in a desired position and prevent twisting of the compound delivery applicator 100 when there are one or more protrusions 540 on the compound receptacle 110 that exert a force against the one or more tabs 530.

Figure 34:
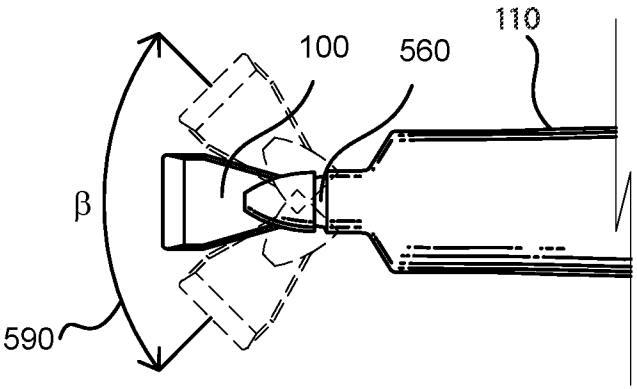

As shown in FIG. 34, in some implementations, the compound delivery applicator 100 may be configured to pivot laterally about the longitudinal axis of the substantially conical portion 115 using a flexible joint 560 between the compound delivery applicator 100 and the compound receptacle 110. The flexible joint 560 may further comprise an internal gear or other locking structure to hold the compound delivery applicator 100 at the desired position once the lateral angle has been adjusted. While any angular range 590 is contemplated by this disclosure, it may be preferable for the angular range 590 to be about 120 degrees to prevent obstruction of the compound delivery channel 160, 510 due to crimping of the compound delivery channel 160, 510.

Figure 35:
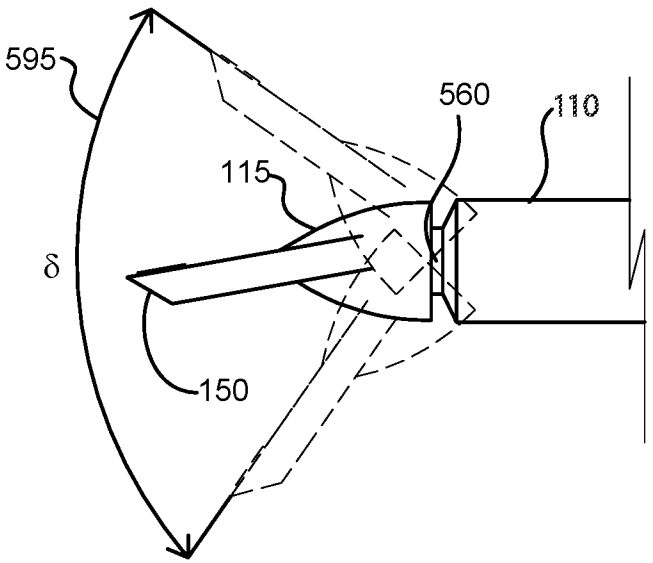
FIGS. 34-35 depict implementations of a compound delivery applicator that pivots laterally and vertically about a longitudinal axis of the substantially conical portion, respectively.

Similarly, as shown in FIG. 35, in some implementations, the compound delivery applicator 100 may be configured to pivot vertically about the longitudinal axis of the substantially conical portion 115 using a flexible joint 560 between the compound delivery applicator 100 and the compound receptacle 110. The flexible joint 560 may further comprise an internal gear or other locking structure to hold the compound delivery applicator 100 at the desired position once the lateral angle has been adjusted. While any angular range 595 is contemplated by this disclosure, it may be preferable for the angular range 595 to be about 120 degrees to prevent obstruction of the compound delivery channel 160, 510 due to crimping of the compound delivery channel 160, 510.

Figure 38:
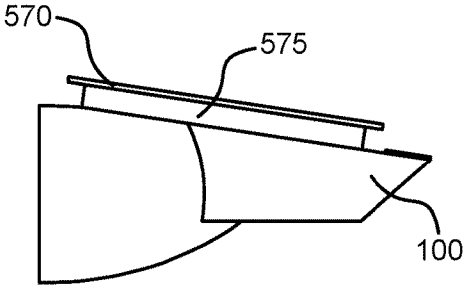
FIG. 38 depicts and implementation of a compound delivery applicator comprising a sanding surface on exterior surface.

Some implementations of a compound delivery applicator 100 may further comprise a sanding surface 570 located on an exterior of the compound delivery applicator 100. As shown in FIG. 38, by non-limiting example, the sanding surface 570 may be located on an upper side of at least a portion of the substantially conical portion 115 and the applicator blade 135 such that a user may simply flip the compound delivery applicator 100 over to sand the surface to which a compound was applied. A riser 575 may be located between the sanding surface 570 and the substantially conical portion 115 and applicator blade 135 to create a smooth surface onto which a sanding material such as for example, sandpaper or any appropriately rough material may be applied or adhered.

In other implementations, the compound delivery applicator 100 may further comprise a cap 580 into which the compound delivery applicator 100 fits and which may be secured to the compound receptacle 110. A sanding surface 570 may be located at an end of the cap distal the open end 585 such that the cap 580 may be applied to the compound delivery applicator 100 and the compound receptacle 110 serves as a handle for the user to sand a surface to which a compound was applied.

Figure 37:
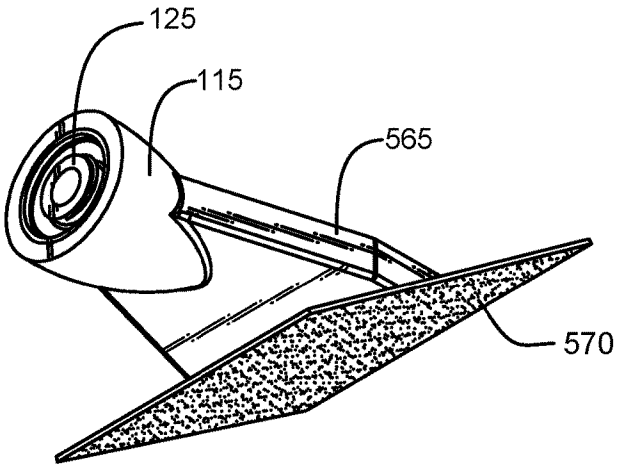
FIGS. 36-37 depict implementations of an interchangeable sanding tip.
Figure 36:
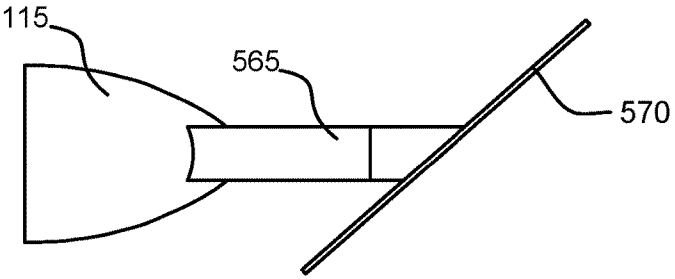
Figure 39:
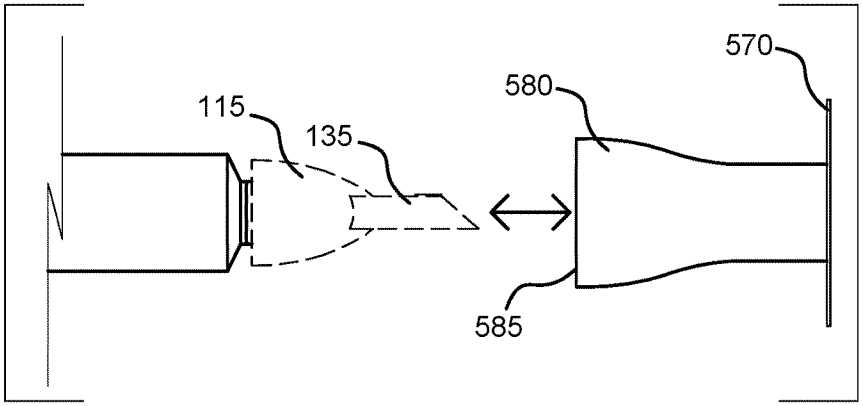
FIG. 39 depicts an implementation of a compound delivery applicator comprising a cap with a sanding surface.

In other implementations, a separate sanding tool may be interchangeable with the compound delivery applicator 100 as shown in FIGS. 36-37. The sanding tool may comprise a neck 565 and a sanding surface 570 to which a sanding material may be attached or adhered. In some embodiments, the sanding tool may further comprise a substantially conical portion 115 which may comprise threads 125 so that the sanding tool may be threadably coupled to a compound receptacle 110 for use as a handle when the sanding tool is in use.

While it is intended that any number of the components comprising the compound delivery applicator, compound receptacle, plunger, etc. may be comprised of separately manufactured and assembled parts, some implementations may also be integrally formed so as to provide manufacturing efficiencies. It is contemplated that any of the components described in this disclosure may be comprised of any synthetic material, polymer, plastic, or any other suitable material that may be desired to be used in such implementations.

Figure 25:
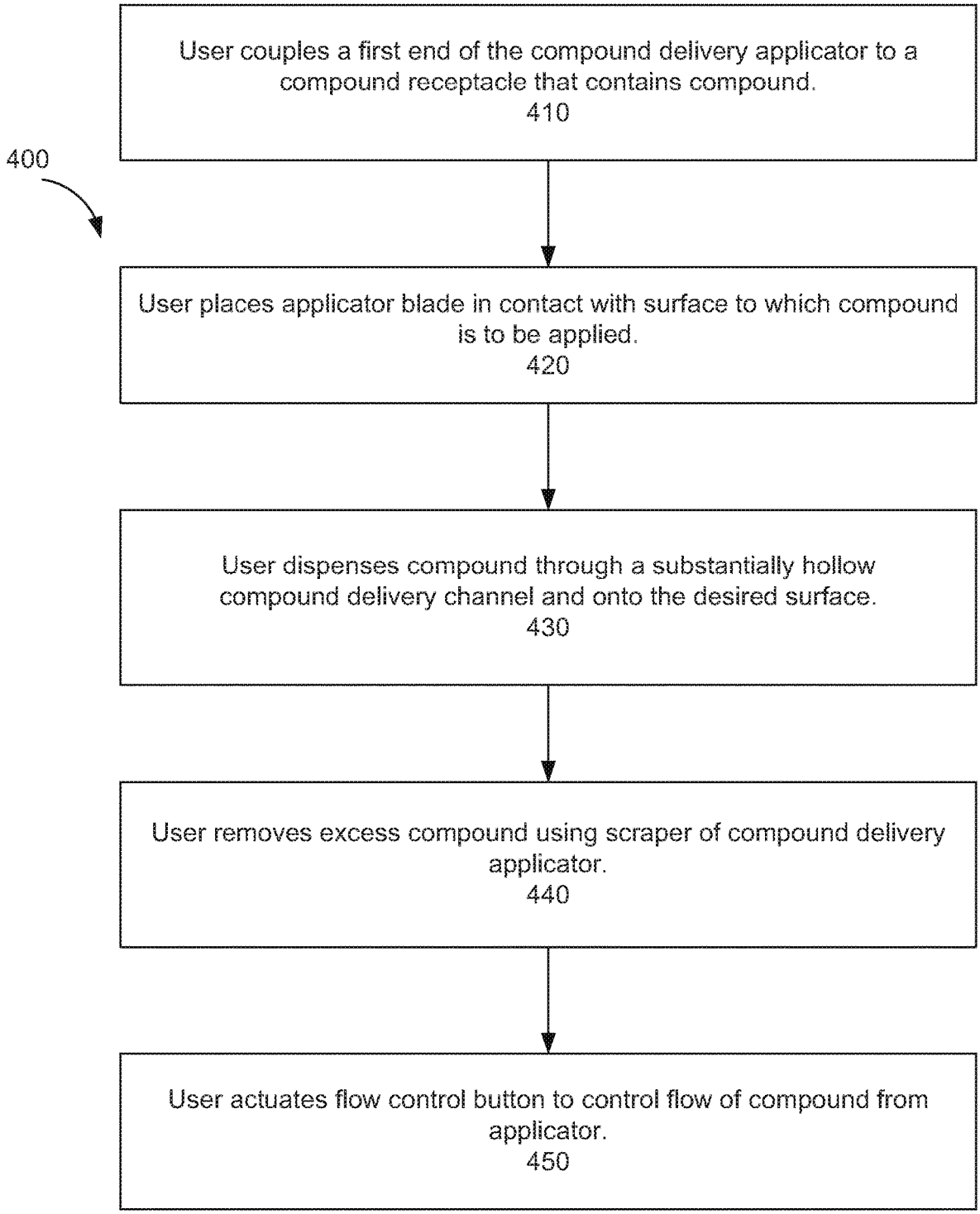
FIG. 25 is a block diagram of a method of applying a compound using a compound delivery applicator.

FIG. 25 provides a block diagram of a method of applying a compound 400 using an implementation of a compound delivery applicator in accordance with the above disclosure. When a user has identified a surface to which the user desires to apply a compound, the user may couple a first end of a substantially conical portion of the compound delivery applicator to a compound receptacle containing a compound 410. The compound receptacle may further comprise a cartridge that may be disposable or refillable for multiple uses. The user may then place an applicator blade that is coupled to the substantially conical portion of the compound delivery applicator in contact with a surface to which the compound is to be applied 420. The applicator blade may comprise a first portion extending outwardly along a longitudinal axis of and from a second end of the substantially conical portion and the first portion may comprise a first side edge and a second side edge each forming an acute angle relative to the longitudinal axis of the substantially conical portion. The user may then dispense the compound through a hollow compound delivery channel extending internally through at least a portion of the substantially conical portion 430, the hollow compound delivery channel further extending through a scraper of the applicator blade coupled to the first portion distal the substantially conical portion. Once the compound has been applied and smoothed on the desired surface, the user may remove the excess compound using at least a portion of an edge of the scraper distal from the first portion of the applicator blade 440. The user may also actuate a flow control button 450 that is located within a recessed channel along at least a portion of an edge of the scraper distal from the first portion of the applicator blade between open and closed positions to control flow of the compound through the hollow compound delivery channel to prevent drying of the compound within the compound receptacle when the applicator is not in use.

It will be understood that embodiments and implementations described and illustrated herein are not limited to the specific components disclosed herein, as virtually any components consistent with the intended operation of a method and/or system implementation for compound application may be utilized. In places where the description above refers to particular embodiments of a compound delivery applicator and application techniques, it should be readily apparent that a number of modifications may be made without departing from the spirit thereof and that these implementations may be applied to other such systems and components. The presently disclosed implementations are, therefore, to be considered in all respects as illustrative and not restrictive.

The implementations listed here, and many others, will become readily apparent from this disclosure. From this, those of ordinary skill in the art will readily understand the versatility with which this disclosure may be applied.

The invention claimed is:

1. A compound delivery applicator comprising:

an applicator blade comprising:

a first end configured to couple to a compound receptacle;

a compound delivery channel extending from the first end, the compound delivery channel positioned perpendicular to a second end of the applicator blade and configured to pass a compound therethrough, the second end of the applicator blade comprising a scraper distal the first end, wherein the scraper forms a substantially planar edge perpendicular to a longitudinal axis of the compound delivery channel;

a first portion extending outwardly from the first end, the first portion comprising a first side edge and a second side edge each forming an acute angle relative to the longitudinal axis of the compound delivery channel; and a plug configured to detachably seat within the compound delivery channel to obstruct compound flow when the compound delivery applicator is not in use.

2. The compound delivery applicator of claim 1, wherein the compound delivery channel terminates at a distribution surface.

3. The compound delivery applicator of claim 2, wherein a plane in which the distribution surface lies forms an acute angle relative to the longitudinal axis of the compound delivery channel.

4. The compound delivery applicator of claim 1, wherein the first side edge and the second side edge of the first portion each further comprise a portion distal the first end of the applicator blade that is substantially parallel to the longitudinal axis of the compound delivery channel.

5. A method of using a compound delivery applicator comprising:

coupling a first end of an applicator blade of the compound delivery applicator to a compound receptacle;

removing a detachable plug from within a compound delivery channel that extends from the first end and is configured to pass a compound therethrough, wherein the applicator blade comprises a first portion extending outwardly from the first end, the first portion comprising a first side edge and a second side edge each forming an acute angle relative to a longitudinal axis of the compound delivery channel, the compound delivery channel positioned perpendicular to a second end of the applicator blade that comprises a scraper distal the first end, wherein the scraper forms a substantially planar edge perpendicular to a longitudinal axis of the compound delivery channel; and dispensing compound by applying pressure to the compound receptacle.

6. The method of claim 5, further comprising applying the dispensed compound to a surface.

7. The method of claim 6, further comprising removing excess compound from the surface using the scraper.

8. The method of claim 5, wherein the compound delivery channel terminates at a distribution surface.

9. The method of claim 8, wherein the distribution surface is proximal the scraper.

10. The method of claim 8, wherein a plane in which the distribution surface lies forms an acute angle relative to the longitudinal axis of the compound delivery channel.

11. The method of claim 5, further comprising replacing the plug in the compound delivery channel.

12. The method of claim 5, wherein the compound receptacle comprises a tube.

13. A method of making a compound delivery applicator comprising:

forming a first end of an applicator blade of the compound delivery applicator, the first end configured to couple to a compound receptacle;

positioning a compound delivery channel configured to pass a compound therethrough perpendicular to a second end of the applicator blade, the second end comprising a scraper, wherein the scraper forms a substantially planar edge perpendicular to a longitudinal axis of the compound delivery channel;

forming a first portion of the applicator blade that extends outwardly from the first end, the first portion comprising a first side edge and a second side edge each forming an acute angle relative to a longitudinal axis of the compound delivery channel; and seating a detachable plug within the compound delivery channel.

14. The method of claim 13, further comprising threadably coupling the compound delivery applicator to a compound receptacle.

15. The method of claim 14, wherein the compound receptacle comprises a tube.

16. The method of claim 13 wherein the first end of the applicator blade, the compound delivery channel, the scraper, and the first portion of the applicator blade are integrally formed.

17. The method of claim 13, further comprising forming a distribution surface at which the compound delivery channel terminates.

18. The method of claim 13, wherein the distribution surface is proximal the scraper.

19. The method of claim 13, wherein a plane in which the distribution surface lies forms an acute angle relative to the longitudinal axis of the compound delivery channel.

20. The method of claim 13, forming the first side edge and the second side edge of the first portion such that each further comprises a portion distal the first end of the applicator blade that is substantially parallel to the longitudinal axis of the compound delivery channel.

* * * * *